US011300387B2

(12) United States Patent
Lumley

(10) Patent No.: US 11,300,387 B2
(45) Date of Patent: Apr. 12, 2022

(54) FRAME AND LINEAR SHAPED CHARGE

(71) Applicant: LINEAR SHAPED LIMITED, Hartlepool (GB)

(72) Inventor: Andrew Lumley, Alston (GB)

(73) Assignee: LINEAR SHAPED LIMITED, Hartlepool (GB)

( * ) Notice: Subject to any disclaimer, the term of this patent is extended or adjusted under 35 U.S.C. 154(b) by 229 days.

(21) Appl. No.: 16/562,119

(22) Filed: Sep. 5, 2019

(65) Prior Publication Data

US 2019/0390943 A1 Dec. 26, 2019

Related U.S. Application Data

(63) Continuation of application No. PCT/GB2018/050561, filed on Mar. 6, 2018.

(30) Foreign Application Priority Data

Mar. 6, 2017 (GB) ..... 1703551

(51) Int. Cl.
*F42B 1/028* (2006.01)
*F42B 1/036* (2006.01)
*F42B 3/08* (2006.01)

(52) U.S. Cl.
CPC ..... *F42B 1/028* (2013.01); *F42B 3/08* (2013.01); *F42B 1/036* (2013.01)

(58) Field of Classification Search
CPC .... F42B 1/02; F42B 1/028; F42B 3/08; F42B 3/28
See application file for complete search history.

(56) References Cited

U.S. PATENT DOCUMENTS 3,185,089 A * 5/1965 Parkhurst ..... F42B 3/093 102/307
4,815,384 A * 3/1989 Ringel ..... F42B 3/08 102/307
5,036,771 A * 8/1991 Alford ..... F42B 3/08 102/307

(Continued)

FOREIGN PATENT DOCUMENTS

DE 3739683 A1 * 6/1989 ..... F42B 1/028
DE 3739683 A1 6/1989

(Continued)

OTHER PUBLICATIONS

United Kingdom Search Report dated Sep. 26, 2017 for UK Application No. GB1703551.0.

(Continued)

*Primary Examiner* — Gabriel J. Klein
(74) *Attorney, Agent, or Firm* — EIP US LLP

(57) ABSTRACT

A frame for a linear shaped charge. In examples, the frame comprises: a first plate having a first surface; and a second plate having a second surface. The frame is configurable between an un-collapsed state and a collapsed state. In the un-collapsed state, there is a void for receipt of explosive material, with the first surface as a first side of the void, the second surface as a second side of the void, and the first surface angled relative to the second surface by an angle within the void of greater than 180°. In the collapsed state the void is at least partly collapsed.

24 Claims, 5 Drawing Sheets

(56) References Cited

U.S. PATENT DOCUMENTS

| | | | | |
|---|---|---|---|---|
| 8,904,934 | B1 * | 12/2014 | Scheid | F42B 3/08 102/307 |
| 2005/0126420 | A1 * | 6/2005 | Givens | F42B 3/02 102/310 |
| 2015/0219427 | A1 * | 8/2015 | Alford | F42B 1/028 102/307 |

FOREIGN PATENT DOCUMENTS

| | | | | | |
|---|---|---|---|---|---|
| DE | 102017012107 | B3 | * | 4/2019 | F42B 1/02 |
| GB | 2105825 | A | | 3/1983 | |
| GB | 2221285 | A | | 1/1990 | |
| GB | 2254402 | A | * | 10/1992 | F42B 3/08 |
| GB | 2503186 | A | * | 12/2013 | F42B 1/028 |

OTHER PUBLICATIONS

International Search Report and Written Opinion dated Jun. 7, 2018 for PCT Application No. PCT/GB2018/050561.

* cited by examiner

FRAME AND LINEAR SHAPED CHARGE

CROSS-REFERENCE TO RELATED APPLICATIONS

This application is a continuation of International Application No. PCT/GB2018/050561, filed Mar. 6, 2018, which claims priority to UK Application No. GB 1703551.0, filed Mar. 6, 2017, under 35 U.S.C. § 119(a). Each of the above-referenced patent applications is incorporated by reference in its entirety.

BACKGROUND OF THE INVENTION

Field of the Invention

So-called "user-fillable" linear shaped charges are known, which allow a user to assemble the shaped charge on demand either at the site where it will be detonated, or locally thereto. Such a user-fillable charge is for example a rigid assembly in which explosive material can be packed to assemble the charge ready for detonation. However, such a rigid assembly is bulky and awkward to transport and store.

It is desirable to improve a user-fillable linear shaped charge.

DETAILED DESCRIPTION OF CERTAIN INVENTIVE EMBODIMENTS

Examples described herein relate to a frame for a linear shaped charge. The frame comprises a first plate having a first surface and a second plate having a second surface. The frame is configurable between an un-collapsed state and a collapsed state. In the un-collapsed state, there is a void for receiving explosive material, with the first surface being the first side of the void and the second surface being the second side of the void. In the un-collapsed state the first surface is angled relative to the second surface by an angle within the void of greater than 180°. In the collapsed state the void is at least partly collapsed.

The frame in the collapsed state may therefore be more compact and/or better shaped to be packed and transported than when in the un-collapsed state. This is for example feasible if the void is free from explosive material which would otherwise hinder or prevent collapsing the frame from the un-collapsed state. Thus, there is added design freedom for a more compact design of frame, which is realised by providing the collapsed state of examples described herein.

Examples will now be described with reference to FIGS. 1 to 4.

Figure 1:
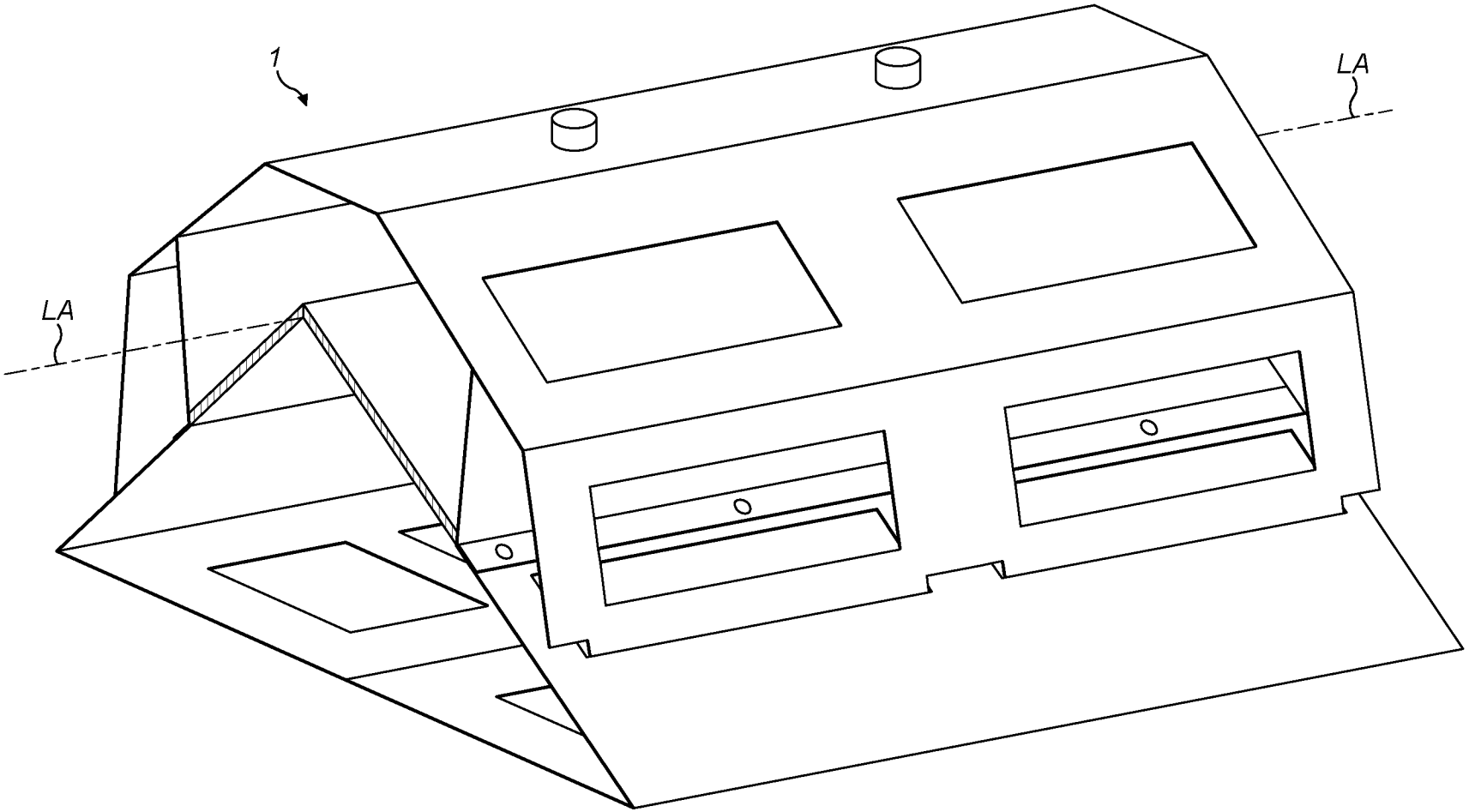
FIG. 1 shows schematically a frame according to examples.
Figure 2:
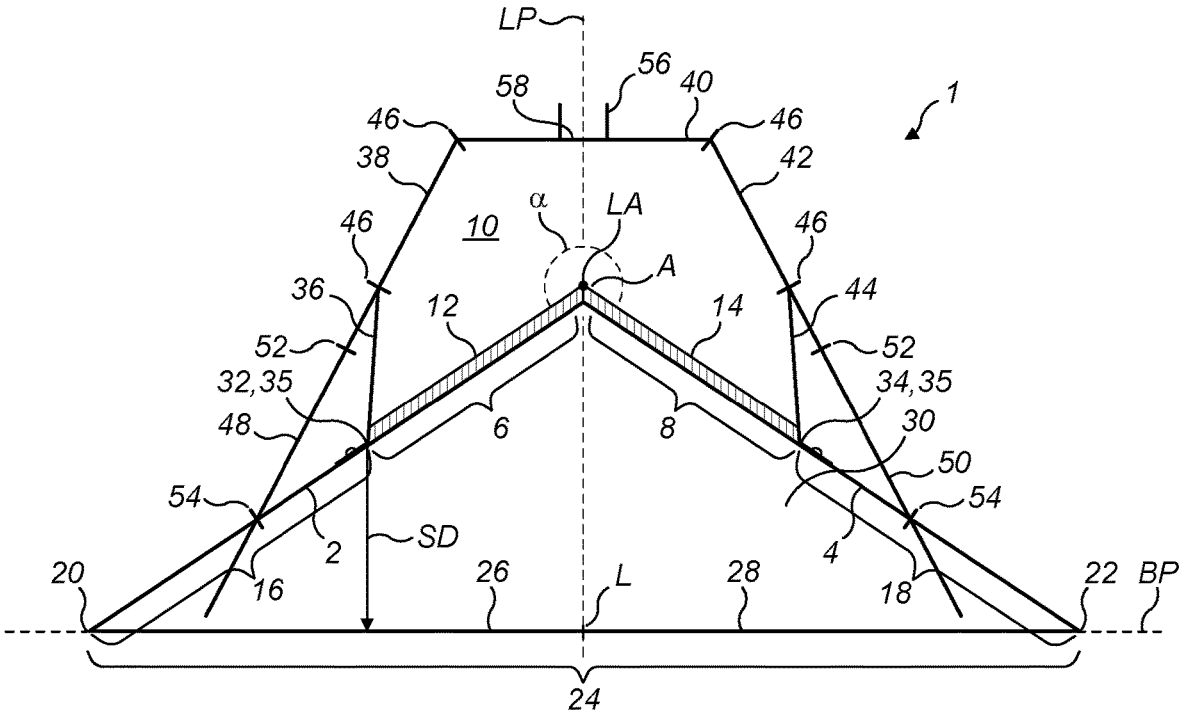
FIGS. 2, 3 and 4 show schematically, in cross-section, the frame in various states from an un-collapsed state to a collapsed state.

FIG. 1 shows schematically a perspective view of the frame according to examples. FIG. 2 shows such a frame in cross-section, taken in a plane perpendicular a longitudinal axis LA, with the frame in the un-collapsed state.

The frame 1 may in examples be considered a structure or apparatus which in the un-collapsed state gives a user a framework to assemble a linear shaped charge. For example, features of the frame (explained further below) give the appropriate geometry and structural support for user-providable features for assembling the linear shaped charge to be detonated. For example, the void is provided with appropriate volume and geometry, and an appropriate stand-off distance may be provided.

The frame has a first plate 2 and a second plate 4. A plate is for example a planar member, sheet or board, for example of a moulded plastic material such as acrylonitrile butadiene styrene (ABS), polyvinylchloride, polyethylene, or acrylic or foam such as low density polyethylene foam (LDPE).

In the example of the FIG's, a first portion 6 of the first plate 2 and a second portion 8 of the second plate 4 each comprise a metal, such as copper metal. Thus, at least part of each of the first plate and the second plate may comprise copper. Each such metallic portion may be a layer of metallic material adhered to a surface of a layer of plastic or other material which extends to form another portion of the plate. Or, a portion of the plate may be formed of a metallic material, and another portion of the plate may be formed of a plastic material such as ABS, polyvinylchloride, polyethylene, or acrylic, or foam such as LDPE.

In the un-collapsed state, there is a void 10 within the frame. As will be explained later, explosive material may be packed by a user in the void to form a linear shaped charge ready for detonation. Hence, the frame may be considered to be "user-fillable". The shape of the void corresponds to a shape desired or usable in a linear shaped charge, and the frame is designed such that in the un-collapsed state the void has this shape.

Referring to FIG. 2, a first surface 12 of the first plate (for example of the first portion) is a first side of the void and a second surface 14 of the second plate (for example of the second portion) is a second side of the void. The first and second plates 2, 4 are positioned such that the first and second surfaces meet and may contact each other along the longitudinal axis, at an apex A within the void. A longitudinal edge of each of the first portion and the second portion may be mitred, so that they contact each other more intimately along the apex A with the frame in the un-collapsed state, and in turn may give more structural support to the frame in the un-collapsed state. In the un-collapsed state the first surface is angled relative to the second surface by an angle $\alpha$ within the void of greater than 180°. The angle $\alpha$ for example is in the range of 260 to 280 degrees.

With the first and second plates positioned in this way, the first and second portions, each comprising metallic material such as a layer of copper, together form a liner for the linear shaped charge. As the skilled person will appreciate, when the linear shaped charge is detonated, explosive material will cause metallic particles in the liner to be projected as a jet towards a base plane BP of the linear shaped charge.

In examples such as those of the FIG's, the first plate and the second plate each extend beyond the void. Thus, with the first portion of the first plate and the second portion of the second plate both corresponding with the void, a third portion 16 of the first plate and a fourth portion 18 of the second plate each extend beyond the void. In other words, the third and fourth portions do not correspond with the void.

Referring to FIG. 2, the first and second plates are similar if not the same in size. Thus, the size of the third and fourth portions, at least as shown in the cross-section of FIG. 1 may be the same. An edge of the first plate 20 and an edge of the second plate 22 each lie in the base plane BP. Thus, the edges of the first and second plates provide support to the frame in the un-collapsed state.

In examples such as that of the FIG's, the frame comprises a base assembly 24 connected to the first plate and the second plate. The base assembly is for example hingeable, such that it can be hinged between a folded configuration in the collapsed state, and an unfolded configuration in the un-collapsed state. Referring to FIG. 2, the base assembly comprises a third plate 26 and a fourth plate 28. The third plate 26 is hingeably connected to the first plate (in this case at the edge 20) and the fourth plate 28 is hingeably connected to the second plate (in this case at the edge 22). The fourth plate is hingeably connected to the third plate, for example along a line L parallel the longitudinal axis LA and in a longitudinal plane LP taken perpendicular the base plane BP.

The third plate and the fourth plate are each for example formed of a plastic material, which may be the same as at least the third and fourth portions of the first and second plates.

In the un-collapsed state, the base assembly, the first plate and the second plate together correspond with a stand-off space 30. Thus, between the first portion of the first plate, the second portion of the second plate and the base assembly, there is a stand-off space, with surfaces of the first plate, the second plate and the base assembly (for example the third and fourth plates) being respective sides of the stand-off space. Hence, the third and fourth plates correspond with a base side of the stand-off space, and for example lie in the base plane BP.

The shape and volume of the stand-off space, including a stand-off distance SD of the linear shaped charge, depends on the dimensions of the first and second plates and the base assembly. For example, the stand-off space may have a substantially triangular cross-section, with the cross-section taken in a plane perpendicular a longitudinal axis of the frame. In examples the term substantially triangular covers deviations from a perfect triangle due to acceptable manufacturing tolerances of the frame, and/or acceptable deviations due to an imperfect un-collapsing of the frame (for example if the third and fourth plates cannot be completely unfolded to lie in the base plane). The dimensions of the first, second, third and fourth portions of the first and second plates, and of the base assembly, can be selected to give a desired stand-off space geometry.

With appropriate design, for example with the stand-off space being substantially triangular with the frame in the un-collapsed state, the base assembly at least partly holds the frame in the un-collapsed state. By saying at least partly, it is to be understood that the base assembly alone may not hold the frame in the un-collapsed state. Other parts of the frame may contribute too.

Further, with the hingeable connection between the third and fourth plates, and the meeting of the first and second portions of the first and second plates, lying on the longitudinal plane LP, the frame may have additional structural strength.

A substantially triangular stand-off space helps to give a sufficiently strong structural support to the frame. Moreover, with the base assembly unfolded, such that for example the third and fourth plates lie in the base plane BP, a base side of the triangle can resist or prevent folding of the base assembly, thereby in turn keeping the edges of the first and second portions with the desired angle at the apex, and hence the frame in the un-collapsed state. In some examples, if the base plane is placed on a horizontal target surface, gravity can act to keep the base assembly unfolded, again helping to keep the frame in the un-collapsed state.

In examples, the frame comprises an articulate assembly. An articulate assembly is for example any assembly, structure or element which can be articulated, bent or otherwise shaped. In the un-collapsed state, the void is located between the articulate assembly and the first surface and the second surface. Thus, the shape and size of the void may be determined by appropriate articulation of the articulate assembly, and more specifically by interior surfaces thereof, the first surface and the second surface.

In examples such as that of FIG. 2, the articulate assembly comprises a first edge 32 connected to the first plate and a second edge 34 connected to the second plate, each for example by a hingeable connection 35. The articulate assembly comprises one or more plates, for example a fifth plate 36 having the first edge 32, a sixth plate 38 connected to the fifth plate, a seventh plate 40 connected to the sixth plate, an eighth plate 42 connected to the seventh plate, and a ninth plate 44 having the second edge 34. One or more of such connections may be a hingeable connection 46. Each such plate may be formed of a plastic material and be rigid and hence non-flexible, for example ABS, polyvinylchloride, polyethylene, or acrylic. Each plate extends along the length of the frame, to form a longitudinal void with the cross-section shown in FIG. 2.

With appropriate articulation of the articulate assembly, each plate 36, 38, 40, 42, 44 is angled, at each of the hingeable connections, relative to an adjacent plate by a suitable angle to determine the shape and size of the void. It is to be appreciated that in other examples, the number of plates of the articulate assembly may be different than shown in FIG. 2, to give a different shaped and sized void.

The frame may comprise a first support element connected to the first plate and a second support element connected to the second plate. With the frame in the un-collapsed state, the first support element and the second support element each support the articulate assembly to at least partly hold the frame in the un-collapsed state. For example, the support elements provide lateral support to the parts of the articulate assembly which form the void, to reduce or prevent lateral distortion of the void.

In some examples, the articulate assembly comprises the first support element and the second support element. Hence, the articulate assembly when connected as described to the first and second plates is self-supporting.

In examples such as that of FIG. 2, the first support element 48 and the second support element 50 are each hingeable between a folded configuration with the frame in the collapsed state and an unfolded configuration with the frame in the un-collapsed state. Each support element may comprise two plates or other elements hingeably connected (52) to each other, as illustrated.

The first support element and the second support element are each hingeably connected, joined or otherwise in contact with for example at least one of the fifth to ninth plates of the articulate assembly described above, or to a hingeable connection therebetween. Further, the first support element and the second support element are each hingeably connected 54 to the first plate and the second plate, respectively, for example the third portion and the fourth portion.

In some examples, the frame comprises at least one extendable support element which can be used to adjust a stand-off distance with the frame in the un-collapsed state. The extendable support element may be one or more legs slidable or retractable into the base assembly or the first or second plate, which legs separate the base plane BP from a surface of the target. For example, there may be one such leg at each corner of the base plane. The skilled person would appreciate alternative implementations, for example an extendable support element may be telescopic rather than slidable.

Figure 3:
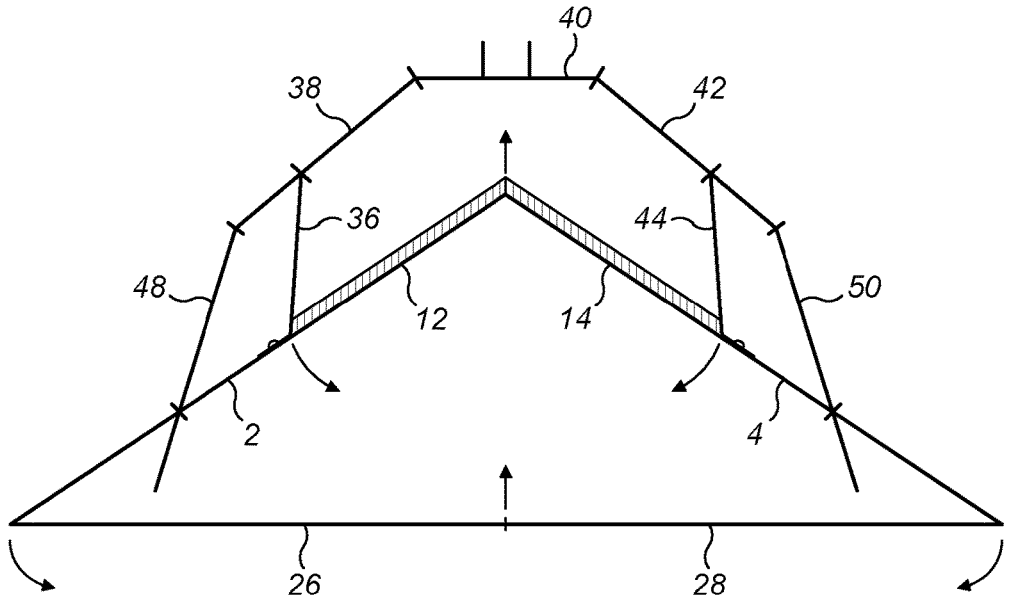

FIGS. 1 and 2 show the frame in the un-collapsed state. FIG. 3 illustrates starting collapse of the frame, with arrows indicating the direction of movement of various parts of the frame, including some hingeable connections. For example, the third and fourth plates hinge inwards and the first and second support elements 48, 50 hinge outwards. The first and second plates move to increase the angle $\alpha$, so the angle is larger than with the frame in the un-collapsed state, for example in examples with the first plate hingeably connected to the second plate at the apex. In other examples, where the first and second plates are not hingeably connected to each other, the first and second portions tend to move away from each other, separating at the apex. In either case, the first plate and the second plate move so as to become more parallel to each other than with the frame in the un-collapsed state.

As the frame is collapsed, the various hingeable connections of the articulate assembly hinge, so that the articulate assembly folds to a collapsed configuration. With the articulate assembly in some examples hingeably connected to the first and second plates, the articulate assembly may help to determine a movement of the first and second plates as the frame is collapsed.

Figure 4:
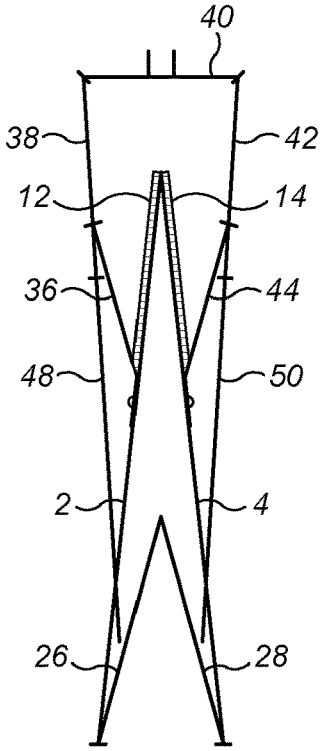

Referring now to FIG. 4, the frame in the collapsed state is illustrated. In this example the first and second plates 2, 4 are hingeably connected at the apex. As can be seen, the articulate assembly is more folded, and the first and second plates are closer to being parallel each other than in the un-collapsed state. As can be seen, the dimensions of the seventh plate 40 determine at least partly a width of the frame in the collapsed state. In some examples, at least one edge of the seventh plate 40 may overhang the sixth and eighth plates respectively, and provide a stop against which the sixth and eighth plates cannot hinge beyond, hence helping to hold the sixth and eighth plates in position and in turn hold the void in a desired shape.

With the frame in the collapsed state, the void is at least partly collapsed compared with the un-collapsed state. Hence, the void has a smaller volume in the collapsed state than in the un-collapsed state. In some examples, such as those of FIGS. 1 to 4, the stand-off space is at least partly collapsed in the collapsed state compared with in the un-collapsed state.

Hence, in the collapsed state the frame is notably more compact than in the un-collapsed state. Moreover, the design of examples described herein occupies a generally rectangular cross-section, and so is easier for packing and transporting one or more collapsed frames, for example in a bulk transportation container. With the frame being a so-called user-fillable frame, such that explosive material is packed in the void when the frame is in an un-collapsed state, the frame can be transported without the explosive material, giving more options for transporting the frame, without the normal restrictions which would apply to transporting a device with explosive material.

In the un-collapsed state, the frame for example has a first end and a second end spaced from the first end along the longitudinal axis of the frame, with at least one of the first end or the second end open. In use, the user un-collapses, or opens, the frame from the collapsed, or closed, state, and packs explosive material into the void, between the liner and the articulate assembly, until the appropriate amount is inserted. The shape of the void, determined for example by the plates of the articulate assembly and the first and second portions of the first and second plates, respectively, helps to ensure the explosive material is packed with the required geometry, and thickness profile, to give suitable performance of the linear shaped charge when detonated.

The explosive material is for example PE8 plastic explosive, available from Chemring Group PLC, Troon House, Ardeer Site, Stevenston, Ayrshire KA20 3LN, Scotland, United Kingdom.

In examples, such as that shown with FIG. 2, the articulate assembly, such as the seventh plate, comprises an opening 56 or port through the articulate assembly. The opening or port is configured to receive a detonator, for detonating the explosive material once packed in the void. The opening may comprise a metallic layer, for example a disc 58 or plate of for example copper metal or another suitable metal or metallic material. The disc or plate is located within the opening, or covers an end of the opening nearest the void, to at least partially obstruct the opening, for example without any gaps surrounding the disc or plate, to therefore seal off the void from the opening. Thus, when packing the void, a user can pack the explosive material into the void, and also in the opening on the other side of the metallic layer, firmly against and in intimate contact with the metallic layer, without explosive material bulging into the opening, which might compromise performance of the linear shaped charge when detonated. The thickness profile and material of the disc or plate is selected such that, when a detonator inserted in the opening is fired, the wavefront of the detonation pulse is transmitted by and through the disc or plate, to the explosive material, so it is effectively detonated.

Once the frame has been packed with explosive material, and in some examples described below also provided with a liner, the linear shaped charge is assembled and ready to be attached to a target (for example with appropriate adhesive on an outer side of the base assembly) and fired.

Figure 5:
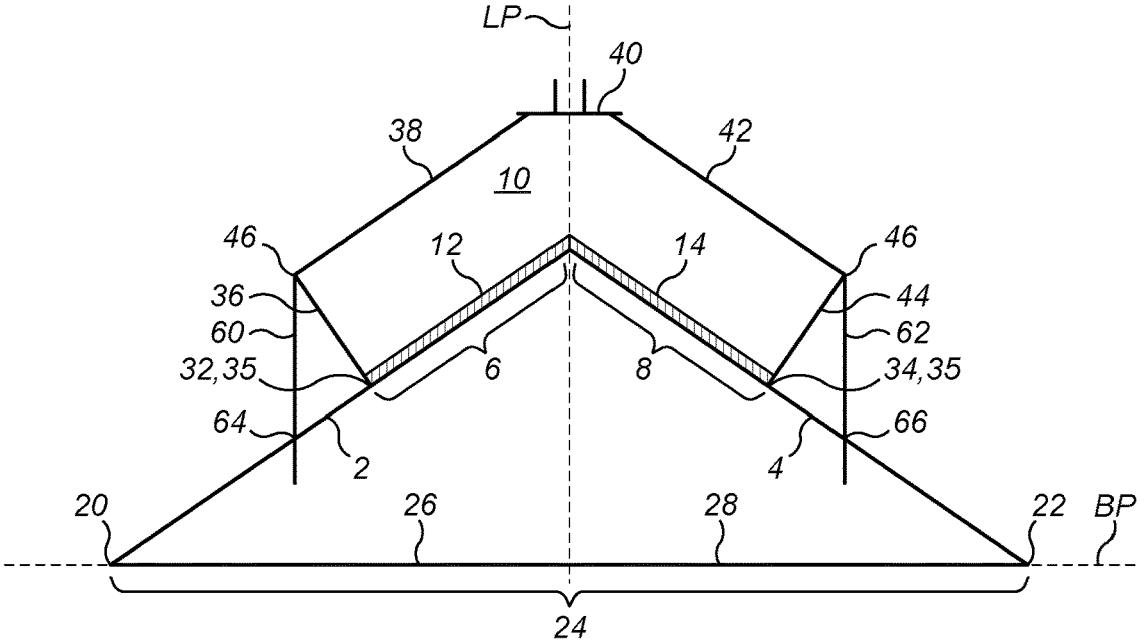
FIG. 5 shows schematically a frame according to different examples.

Further examples of a frame are described with respect to FIG. 5. Many features of such a frame are similar to those described above, and are labelled with the same reference numerals; corresponding descriptions apply also. In these examples, the void 10 has a different geometry compared with that shown in FIG. 2. This is for example due to different dimensions of plates of the articulate assembly, but also with the first and second support elements 60, 62 not in these examples being hingeable between folded and unfolded configurations, compared with those illustrated earlier. Specifically, the first and second support elements 60, 62 are each non-hingeable support elements, for example longitudinal elements such as plates, which are each respectively hingeably connected 46 along a longitudinal edge to the articulate assembly such as any of the fifth to ninth plates of the articulate assembly. Each of the first and second support elements are connectable to the first and second plates at locations 64, 66 shown in FIG. 5. For example, each of the first and second support elements may have tabs, protrusions, or an otherwise suitably shaped portion which is receivable respectively by the third and fourth portions of the first and second plates respectively. For example, a tab or series of tabs along each support element may, when the first and second support elements are appropriately positioned via the hingeable connections 46, insert respectively into a series of slots, openings or otherwise suitably shaped recesses in each of the third and fourth portions, to hold the first and second support elements in position, and in effect lock or at least partly hold the frame in the un-collapsed state. To collapse the frame, this process is reversed, and the first and second support elements may be disconnected from the first and second plates, to for example withdraw the tabs from the series of slots. This process may be enabled by the material of the first and second support elements and/or of the first and second plates being suitably deformable. In other examples the tabs, protrusions or otherwise suitably shaped portions are inserted in the series of slots in both the collapsed and un-collapsed states, with the tab or equivalent sliding further into or out of the slot appropriately as the frame is transitioned between the collapsed and un-collapsed states.

Figure 6:
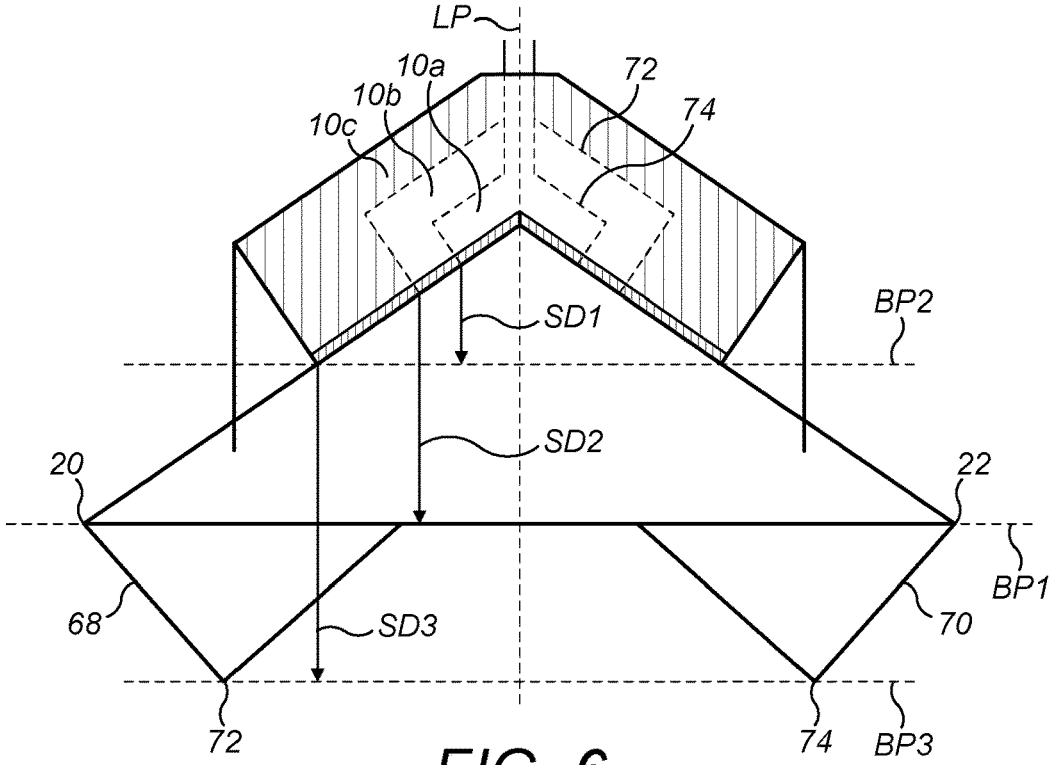
FIG. 6 shows schematically different configurations of support elements and voids according to examples.

Further examples are illustrated with respect to FIG. 6. The frame shown in this Figure is similar to that of FIG. 5 and hence for clarity the same features are not labelled. It is noted that the base plane BP and void 10 described earlier corresponds with labels BP1 and 10*c* respectively in FIG. 6. FIG. 6 illustrates different configurations of the frame in the un-collapsed state. The void geometry and dimensions may be changed using shaped elements, for example of foam such as LDPE foam, insertable into the void 10*c*. So, for example, using appropriately sized shaped elements, a smaller void 10*a* or 10*b* may be created, having for example a cross-sectional outline shown respectively by dotted lines 74 or 72. The shaped elements for creating void 10*b* are illustrated with diagonal shading in the Figure, and may be foam inserts. For example, a pair of longitudinal shaped elements, each with for example an L-shaped cross-section, may be inserted, one on either side of the longitudinal plane LP in the void 10*c*. Each shaped element may also be shaped to allow for explosive material when packed in the void to also still be packed against the opening described earlier.

By changing the size of the void in this way, an explosive loading of a resulting linear shaped charge, when the void is packed with explosive material, may be adjusted, with the proportion of the liner of each of the first and second plates in contact with explosive material changed correspondingly.

For such different explosive loadings, a different stand-off distance may be required. Hence, for an explosive loading corresponding to the smallest void shown 10*a*, a smaller stand-off distance SD1 may be obtainable with for example the base assembly being removable, together with for example the third and fourth portions of the first and second plates respectively. This may be implemented by having weakened longitudinal parts of the first and second plates, along respectively the edge of the first and second portions of the first and second plates respectively, such that the first and second plates may be each broken, snapped or otherwise split to remove the third and fourth portions. Hence, once the base assembly and third and fourth portions are removed in this way, the linear shaped charge has a different base plane BP2 and hence a different, reduced, stand-off distance SD1. With the explosive loading corresponding to the medium sized void shown 10*b*, the frame may be used as described with respect to FIG. 2 earlier, with the base plane BP1 corresponding to the base plane BP and stand-off distance SD2 as illustrated. With the highest explosive loading, corresponding to the largest void 10*c*, a larger stand-off distance SD3 may be required. This may be achieved using the at least one extendable support element described earlier. In this example, such an extendable support element may be legs or supports 68, 70, which fold out, via hingeable connections 20, 22, and in some examples via further hingeable connections 72, 74, to form appropriate supports, such as those shown which are triangular in cross-section. Such extendable support elements are sized such that when extended they give the desired stand-off distance SD3, with the base plane BP3.

It is to be appreciated that in such examples the shape and size of the shaped elements, and the different stand-off distances, are designed in accordance with each other, to give the appropriate stand-off distance for the appropriate explosive loading. It is to be further understood that, with pairs of shaped elements having L-shaped cross-sections, they may be tessellated with each other to allow for more compact packing and storage when not inserted in the frame.

Figure 7:
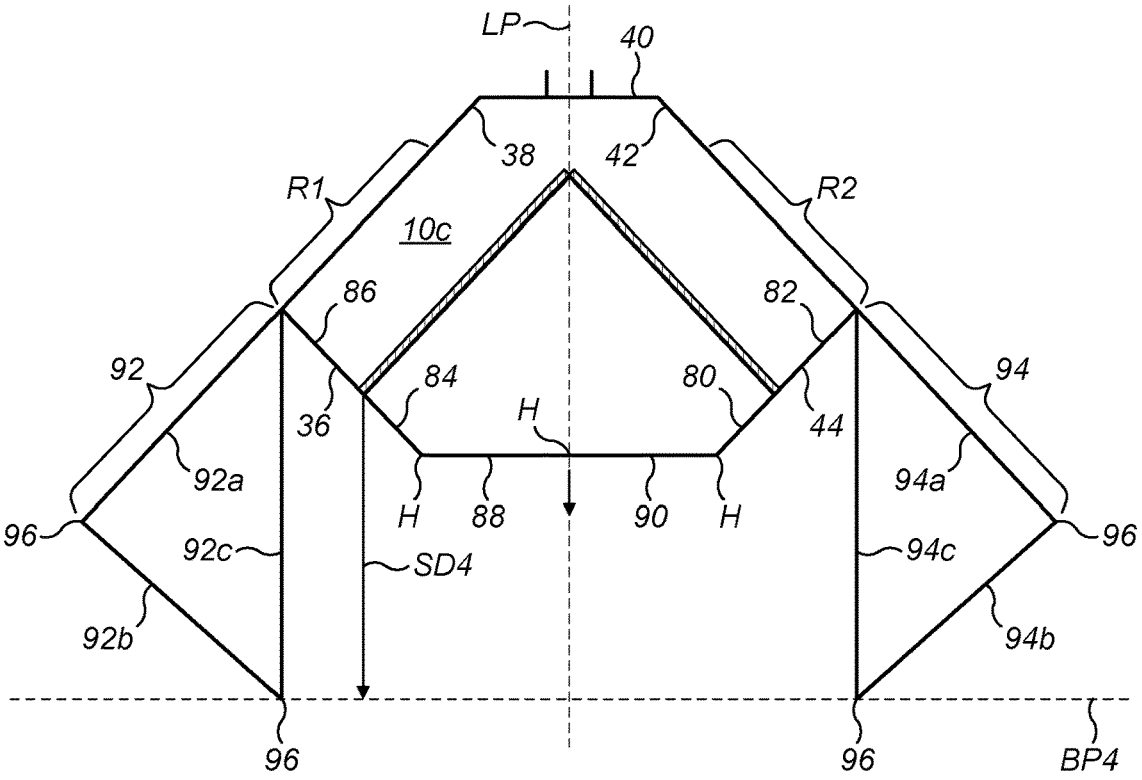
FIGS. 7, 8 and 9 show schematically a frame according to further examples in different configurations.
Figure 8:
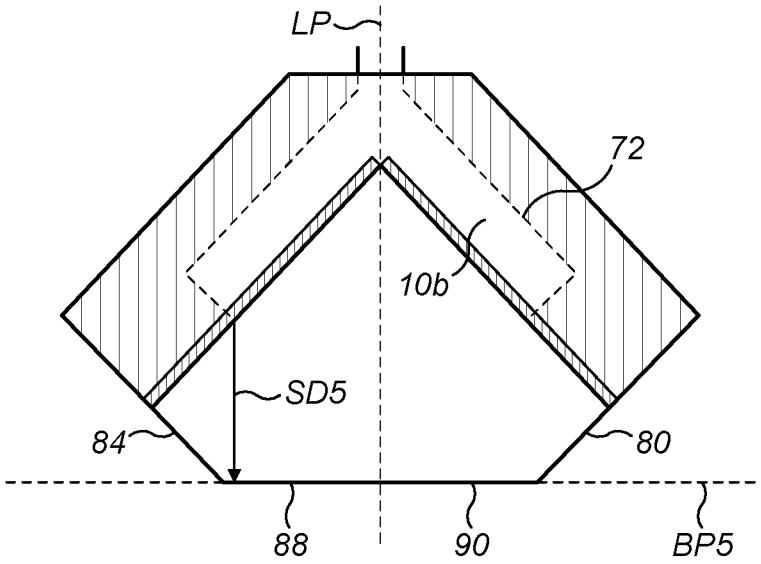
Figure 9:
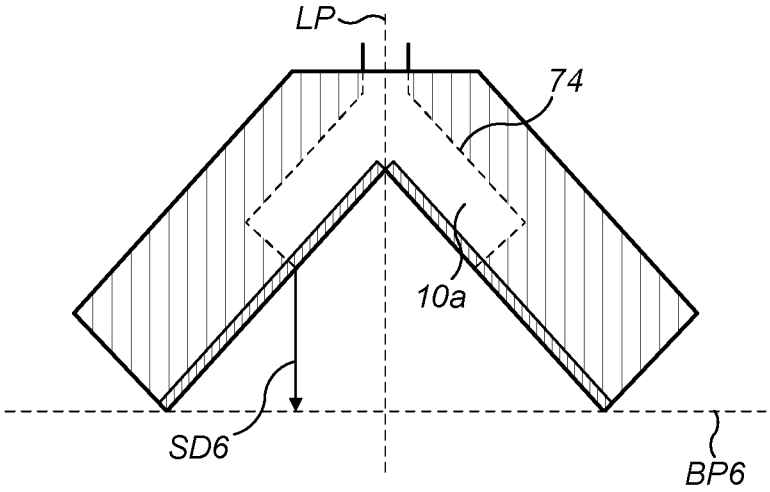

FIGS. 7, 8 and 9 show schematically a further example of a frame which is similar to that illustrated with FIG. 6, but with some differences. The void and features forming the void are similar to those in FIG. 6 and described previously; corresponding descriptions should be taken to apply here. Similarly, the different sizes of void may be selected using appropriate shaped elements; such voids are labelled 10*a*, 10*b* and 10*c*.

As can be seen from FIGS. 7, 8 and 9, the frame in these examples has a different base assembly than examples described previously. In these examples with the frame in the un-collapsed state the base assembly comprises a plurality of plates which extend from one side of the void to another side of the void. For example, one plate 80 extends from and along a short side 82 of the void (corresponding with a plate of the articulate assembly) and towards the longitudinal plane LP. Another plate 84 extends along a short side 86 of the void (corresponding with a different plate of the articulate assembly) and towards the longitudinal plane LP. Two further plates 88, 90 connect between the one and another plates 80, 84. For example the one plate 80 is hingeably connected H to one of the further plates 90, which is hingeably connected H to the other of the further plates 88, which is in turn hingeably connected H to the another plate 84. In the un-collapsed state the two further plates 88, 90 lie in a plane, and may correspond with a base plane (depending on the configuration of the frame), and the hingeable connections in that plane are in compression (compared with the hingeable connections in FIG. 2 for example being in tension). It is noted that when the frame in these examples is collapsed, the hingeable connection H between the two further plates 88, 90 hinges downwards (as indicated with the arrow), in the opposite direction to for example hinging of the liner at the apex. Compared with the examples described previously the first and second plates therefore have the first and second portions, respectively, but not the third and fourth portions, In such examples, there is a first foldable support element 92 and a second foldable support element 94. The first foldable support element 92 comprises a plurality of plates hingeably connected to each other, for example three plates 92*a*, 92*b*, 92*c* which are folded via hingeable connections 96 to form a support element in an unfolded configuration with a triangular cross section. One plate 92*a* extends to overlap and is adhesively attached along the region R1 to a plate of the articulate assembly which forms part of the void. Hence the first foldable support element may be attached to a side of the void. Another plate 92*b* forms a for example 90 degree +/−10 degrees angle with plate 92*a*. Another plate 92*c* has a free edge which is tucked or inserted into a space between the short side 86 of the void and the plate 92*a*. This gives a sufficiently strong support member 92.

The second foldable support element 94 is configured similarly to the first foldable support element 92; the same description applies here too except with the label 94 instead of 92 and R2 instead of R1.

The material of the plates of the foldable support elements is for example the same as described for other plates.

With the two foldable support elements unfolded, the frame can be stood on a target surface corresponding with base plane BP4. The dimensions of the foldable support elements may be selected to give the appropriate stand-off distance SD4 from the base plane BP4, in correspondence with the void size.

FIG. 7 shows the frame in a first configuration. FIG. 8 illustrates the frame in a second configuration, with the two foldable support elements removed, for example by having been broken off or detached in the regions R1 and R2. As shown in FIG. 8, the base assembly acts as a support for the frame and the plates 88, 90 in the base plane BP5 give stability to the frame on a target surface. In this configuration, the frame has a shorter stand-off distance SD5 which corresponds with the reduced void space 10*b*.

FIG. 9 shows a further configuration with the base assembly removed, for example by being broken off or detached from the short sides of the void. In this configuration, edges of the first and second plates are placed on a target surface corresponding with the base plane BP6. The dimensions of the first and second plates are designed to give a stand-off distance SD6 corresponding with the smaller void 10*a*.

Such detaching referred to above may be separating two plates previously joined together with adhesive, and hence an appropriate releasable adhesive may be used.

Hence, the configurations shown in FIGS. 7 to 9 give the frame a selectable character for a user to select between different sized linear shaped charges with different sized void sizes and corresponding stand-off distances, as required. It is to be appreciated that the relative dimensions shown in the FIG's may be chosen in the design process, together with appropriately sized and shaped elements, to obtain different sized linear shaped charges, with appropriate stand-off distances and void sizes. Hence the frame can be designed in a scalable manner, to provide a frame and therefore appropriately sized linear shaped charge to meet a desired requirement. This scalability applies to the selectable nature of the frame, meaning that a frame can be designed with for example the three different configurations illustrated in FIGS. 7 to 9, with appropriate dimensions for intended use cases.

The above examples are to be understood as illustrative examples. Further examples are envisaged. For example, the first and second portions respectively of the first and second plates of the frame described above may instead lack the metal or metallic material, with the first and second plates each being entirely a layer or sheet of plastic material. In such examples, a layer of liner material, such as a plate of copper metal, for forming a liner, may be inserted in the void once the frame is in the un-collapsed state, onto each of the first and second portions, before then packing the explosive material onto those layers of liner material. Thus, the liner may be "user-fillable" too.

Examples are described above, with one part of the frame being hingeably connected to another part of the frame. Such a hingeable connection could be any arrangement which permits hinging of the one part relative to the other part. For example, two or more plates which are hingeably connected may be formed from one plate where each hingeable connection is a thinning or weakening of the material of the plate, to allow some degree of flexibility for a hinging motion. Hence, each plate of the articulate assembly may be a portion of a single plate separated from another portion of the single plate by a hingeable connection. In other examples, the hingeable connection may instead be a mechanism, fastener, attachment or other technique, which gives a hinging function. For example, the first and second support elements may be hingeably connected to the first and second plates, respectively, by an interlocking configuration, with the appropriate support element and plate having suitable cut outs which interfit with each other to give a hingeable connection. In further examples, part of the frame may be hingeably connected to another part of the frame, with additional fasteners. For example, edges of the fifth and ninth plates may be rigidly fixed to the first and second plates, respectively, with a hingeable connection immediately adjacent the rigid fixture. The rigid connection therefore ensures a strong connection between the plates, with the hingeable connection still permitting a hinging function. Such a rigid connection may for example be by adhesive, welding (e.g. plastic welding), bolts (e.g. of plastic), rivets (e.g. of plastic) or any suitable fastening technique.

Plates are described above, which may each comprise a continuous layer or layers of material. In other examples, a plate may include at least one cut-out, to reduce the amount of material and reduce weight of the overall frame. Such cut-outs, as the skilled person will appreciate, may be of any size and shape provided the functionality of the frame is not compromised for its intended purpose.

The articulate assembly may in further examples have a different number of plates than as described above. For example there may be fewer rigid plates, or the articulate assembly may be a single flexible, bendable or otherwise articulatable plate or element.

The articulate assembly design at least partly determines the shape and size of the void. The void's shape and size may be further adapted by a user with the frame in the un-collapsed state. For example, at least one spacer, referred to in other examples as a shaped element, appropriately shaped and sized, may be inserted into the void, to reduce the void space. For example, the void without any such spacers, if fully packed with explosive material, would give the linear shaped charge a certain explosive load. If however a linear shaped charge is to be assembled with a smaller explosive load, spacers with appropriate dimensions, when inserted in the space, would reduce the amount of explosive material which can be packed, and perhaps also the amount of liner in contact with the explosive material, to give a linear shaped charge with a lower explosive load.

It is to be noted that various features are described herein with numerical labels, which for clarity are not repeated throughout the description when introducing a new feature. In this way, for example, rather than describing the base assembly with a first plate and a second plate, the base assembly is described above with a third plate and a fourth plate, as the terms first plate (2) and second plate (4) had already been used earlier in the description. In the context, this does not implicitly mean the base assembly also has a first plate and a second plate.

It is to be noted also that in the Figures, various plates are drawn as single lines. It is to be understood that such plates do have a thickness, but the plate is not drawn with this thickness, but instead by a single line, for clarity of illustration.

In further examples, a frame is envisaged which comprises the first plate having a first surface; a second plate having a second surface; and a base assembly connected to the first plate and the second plate. The first plate and the first surface, and the second plate and the second surface, and the base assembly, may be in accordance with such features described earlier for other examples. The frame is configurable between: an un-collapsed state with: a stand-off space between a first portion of the first plate; a second portion of the second plate; and the base assembly, and a collapsed state with the stand-off space at least partly collapsed. The stand-off space in the un-collapsed state and being at least partly collapsed in the collapsed state may be in accordance with the stand-off space described earlier for other examples; corresponding descriptions apply here also. In some such examples, such a frame may be the same or similar as in examples described earlier but without the articulate assembly. Hence, explosive material, and in some examples liner material, may be applied to the first surface and the second surface of the first and second plates respectively, with the frame in the un-collapsed state. The explosive material may be applied as one or more blocks or slabs to each of the first and second surfaces.

Further examples are envisaged within the scope of the following aspects of the present disclosure described below. It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the accompanying claims.

Aspects of the Disclosure

In a first aspect, a frame for a linear shaped charge comprises: a first plate having a first surface; and a second plate having a second surface, the frame configurable between: an un-collapsed state with: a void for receipt of explosive material, with the first surface as a first side of the void and the second surface as a second side of the void, the first surface angled relative to the second surface by an angle within the void of greater than 180°; and a collapsed state with the void at least partly collapsed.

In a second aspect, which may be used in combination with the first aspect, in the un-collapsed state, the first plate contacts the second plate along a longitudinal axis of the void; and in the collapsed state, the first plate does not contact the second plate.

In a third aspect, which may be used in combination with the first aspect, the first plate is hingeably connected to the second plate.

In accordance with a fourth aspect, which may be used in combination with any preceding aspect, the first plate and the second plate each at least partly comprising copper.

In a fifth aspect, which may be used in combination with any preceding aspect, in the un-collapsed state, the angle has a value in the range 260 to 280 degrees.

In a sixth aspect, which may be used in combination with any preceding aspect, in the collapsed state, the angle is larger than with the frame in the un-collapsed state.

In a seventh aspect, which may be used in combination with any preceding aspect, the frame comprises a base assembly connected to the first plate and the second plate.

In an eighth aspect, which may be used in combination with the seventh aspect, the frame the base assembly is hingeable between: a folded configuration with the frame in the collapsed state; and an unfolded configuration with the frame in the un-collapsed state.

In a ninth aspect, which may be used in combination with the seventh or eighth aspect, the base assembly comprises: a third plate hingeably connected to the first plate; and a fourth plate hingeably connected to the second plate and hingeably connected to the third plate.

In a tenth aspect, which may be used in combination with any of the seventh to ninth aspects, in the un-collapsed state the base assembly, the first plate and the second plate together correspond with a stand-off space.

In an eleventh aspect, which may be used in combination with the tenth aspect, in the un-collapsed state the stand-off space is substantially triangular in cross-section taken in a plane perpendicular a longitudinal axis of the frame.

In a twelfth aspect, which may be used in combination with any of the ninth to eleventh aspects, with the frame in the un-collapsed state the third plate and the fourth plate together correspond with a base side of the stand-off space.

In a thirteenth aspect, which may be used in combination with any of the aspects seven to twelve, with the frame in the un-collapsed state, the base assembly at least partly holds the frame in the un-collapsed state.

In a fourteenth aspect, which may be used in combination with any of aspects one to six, the frame comprises a base assembly, the base assembly comprises a plurality of plates extending from one short side of the void to another short side of the void, the plurality of plates each being hingeably connected to another plate of the plurality of plates.

In a fifteenth aspect, which may be used in combination with the fourteenth aspect, in the un-collapsed state, at least two plates of the plurality of plates correspond with a base plane.

In a sixteenth aspect, which may be used in combination with aspects fourteen or fifteen, in the un-collapsed state, the base assembly is removable to configure the frame with a different stand-off distance than with the base assembly not removed.

In a seventeenth aspect, which may be used in combination with any of aspects fourteen to sixteen, the frame comprises a first foldable support element attached to one side of the void, and a second foldable support element attached to another side of the void.

In an eighteenth aspect, which may be used in combination with the seventeenth aspect, the first foldable support element and the second foldable support element each respectively comprise a plurality of plates hingeably connected to each other, each foldable support element configurable with a triangular cross-section in the un-collapsed state.

In a nineteenth aspect, which may be used in combination with aspects seventeen or eighteen, the first foldable support element and the second foldable support element are removable to configure the frame with a different stand-off distance than with the first foldable support element and the second foldable support element not removed.

In a twentieth aspect, which may be used in combination with any preceding aspects, the frame comprises: an articulate assembly with: a first edge connected to the first plate, and a second edge connected to the second plate, and in the un-collapsed state, the void is located between the articulate assembly and the first surface and the second surface.

In a twenty first aspect, which may be used in combination with the twentieth aspect, the articulate assembly comprises: a fifth plate comprising the first edge; a sixth plate connected to the fifth plate; a seventh plate connected to the sixth plate; an eighth plate connected to the seventh plate; and a ninth plate connected to the eight plate and comprising the second edge.

In a twenty second aspect, which may be used in combination with aspects twenty or twenty one, the articulate assembly comprises an opening through the articulate assembly and is configured to receive a detonator.

In a twenty third aspect, which may be used in combination with the twenty second aspect, the frame comprises a metallic layer located within the opening or which covers an end of the opening nearest the void, to at least partially obstruct the opening.

In a twenty fourth aspect, which may be used in combination with the twenty third aspect, the frame comprises: a first support element connected to the first plate; and a second support element connected to the second plate, and with the frame in the un-collapsed state, the first support element and the second support element each support the articulate assembly to at least partly hold the frame in the un-collapsed state.

In a twenty fifth aspect, which may be used in combination with the twenty fourth aspect, the articulate assembly comprises the first support element and the second support element.

In a twenty sixth aspect, which may be used in combination with twenty fourth or twenty fifth aspect, at least one of the first support element or the second support element is hingeable between: a folded configuration with the frame in the collapsed state; and an unfolded configuration with the frame in the un-collapsed state.

In a twenty seventh aspect, which may be used in combination with the twenty fourth or twenty fifth aspect, at least one of the first support element or the second support element is connectable to respectively the first plate and the second plate for the un-collapsed state, and disconnectable from respectively the first plate and the second plate for the collapsed state.

In a twenty eighth aspect, which may be used in combination with any preceding aspects, in the un-collapsed state, the frame has a first end and a second end spaced from the first end along a longitudinal axis of the frame, and the void is open at least one of the first end or the second end.

In a twenty ninth aspect, which may be used in combination any preceding aspects, the frame comprises at least one extendable support element and, with the frame in the un-collapsed state, a stand-off distance is adjustable with the extendable support element.

In a thirtieth aspect, a linear shaped charge comprises: the frame of any preceding aspect, in the un-collapsed state; and the void at least partly comprises explosive material.

In a thirty first aspect, a method of assembling a linear shaped charge comprises: un-collapsing the frame of any of aspects one to twenty nine from the collapsed state to the un-collapsed state; and packing the void at least partly with explosive material.

In a thirty second aspect, a frame for a linear shaped charge comprises: a first plate having a first surface; a second plate having a second surface; and a base assembly connected to the first plate and the second plate, the frame configurable between: an un-collapsed state with: a stand-off space between: a first portion of the first plate; a second portion of the second plate; and the base assembly, and a collapsed state with the stand-off space at least partly collapsed.

In a thirty third aspect, which may be used in combination with aspect thirty two, the base assembly is hingeable between: a folded configuration with the frame in the collapsed state; and an unfolded configuration with the frame in the un-collapsed state.

In a thirty fourth aspect, which may be used in combination with the aspects thirty two or thirty three, the base assembly comprises: a third plate hingeably connected to the first plate; and a fourth plate hingeably connected to the second plate and hingeably connected to the third plate.

In a thirty fifth aspect, which may be used in combination with any aspects thirty two to thirty four, in the un-collapsed state, the base assembly, the first plate and the second plate together correspond with a stand-off space.

In a thirty sixth aspect, which may be used in combination with the thirty fifth aspect, in the un-collapsed state, the stand-off space is substantially triangular in cross-section taken in a plane perpendicular a longitudinal axis of the frame.

In a thirty seventh aspect, which may be used in combination with any aspects thirty two to thirty four, the frame in the un-collapsed state the third plate and the fourth plate together correspond with a base side of the stand-off space.

In a thirty eighth aspect, which may be used in combination with any aspects thirty two to thirty seven, with the frame in the un-collapsed state, the base assembly at least partly holds the frame in the un-collapsed state.

What is claimed is:

1. A frame for forming a linear shaped charge comprising a liner and explosive material, the frame comprising:
- a first plate comprising:
  - a first layer of plastic material; and
  - a first metallic layer on the first layer of plastic material, the first metallic layer having a first surface; and
- a second plate comprising:
  - a second layer of plastic material; and
  - a second metallic layer on the second layer of plastic material, the second metallic layer having a second surface, the second plate hingeably connected to the first plate by the plastic material of the first plate and the second plate,
- the frame configurable between:
  - an un-collapsed state with:
    - a void for receipt of the explosive material, with the first surface as a first side of the void and the second surface as a second side of the void, and
    - the liner of the linear shaped charge, the liner comprising the first metallic layer positioned relative to the second metallic layer such that the first surface is angled relative to the second surface by an angle within the void of greater than 180°; and
  - a collapsed state with the void at least partly collapsed.

2. The frame of claim 1, wherein the plastic material is thinned or weakened, relative to the material of the first plate and the second plate, to hingeably connect the first plate to the second plate.

3. The frame of claim 1, the first metallic layer and the second metallic layer each at least partly comprising copper.

4. The frame of claim 1, wherein at least one of:
- in the un-collapsed state, the angle has a value in the range 260 to 280 degrees; or
- in the collapsed state, the angle is larger than with the frame in the un-collapsed state.

5. The frame of claim 1, comprising a base assembly connected to the first plate and the second plate.

6. The frame of claim 5, wherein at least one of:
- i) the base assembly is hingeable between a folded configuration, with the frame in the collapsed state, and an unfolded configuration with the frame in the un-collapsed state;
- ii) the base assembly comprises a third plate, hingeably connected to the first plate, and a fourth plate hingeably connected to the second plate and hingeably connected to the third plate;
- iii) in the un-collapsed state, the base assembly, the first plate and the second plate together correspond with a stand-off space;

iv) in the un-collapsed state, the base assembly, the first plate and the second plate together correspond with a stand-off space, and the stand-off space is substantially triangular in cross-section taken in a plane perpendicular a longitudinal axis of the frame;

v) the base assembly comprises a third plate, hingeably connected to the first plate, and a fourth plate hingeably connected to the second plate and hingeably connected to the third plate, and wherein, with the frame in the un-collapsed state, the third plate and the fourth plate together correspond with a base side of the stand-off space; or vi) with the frame in the un-collapsed state, the base assembly at least partly holds the frame in the un-collapsed state.

7. The frame of claim 1, comprising a base assembly, the base assembly comprising a plurality of plates extending from one short side of the void to another short side of the void, the plurality of plates each being hingeably connected to another plate of the plurality of plates.

8. The frame of claim 7, in the un-collapsed state, at least one of:

at least two plates of the plurality of plates corresponding with a base plane; or the base assembly is removable to configure the frame with a different stand-off distance than with the base assembly not removed.

9. The frame of claim 7, comprising a first foldable support element attached to one side of the void, and a second foldable support element attached to another side of the void.

10. The frame of claim 9, wherein at least one of:

the first foldable support element and the second foldable support element each respectively comprise a plurality of plates hingeably connected to each other, each foldable support element configurable with a triangular cross-section in the un-collapsed state; or the first foldable support element and the second foldable support element being removable to configure the frame with a different stand-off distance than with the first foldable support element and the second foldable support element not removed.

11. The frame of claim 1, comprising:

an articulate assembly with:

a first edge connected to the first plate, and a second edge connected to the second plate, wherein, in the un-collapsed state, the void is located between the articulate assembly and the first surface and the second surface.

12. The frame of claim 11, wherein at least one of:

a) the articulate assembly comprises:

a fifth plate comprising the first edge;

a sixth plate connected to the fifth plate;

a seventh plate connected to the sixth plate;

an eighth plate connected to the seventh plate; and a ninth plate connected to the eight plate and comprising the second edge;

b) the articulate assembly comprises an opening through the articulate assembly and configured to receive a detonator;

c) the articulate assembly comprises an opening through the articulate assembly and configured to receive a detonator, the frame comprising a metallic layer located within the opening to at least partially obstruct the opening; or d) the articulate assembly comprises an opening through the articulate assembly and configured to receive a detonator, the frame comprising a metallic layer which covers an end of the opening nearest the void to at least partially obstruct the opening.

13. The frame of claim 11, comprising:

a first support element connected to the first plate; and a second support element connected to the second plate, wherein with the frame in the un-collapsed state, the first support element and the second support element each support the articulate assembly to at least partly hold the frame in the un-collapsed state.

14. The frame of claim 13, wherein at least one of:

the articulate assembly comprises the first support element and the second support element;

at least one of the first support element or the second support element is hingeable between a folded configuration, with the frame in the collapsed state, and an unfolded configuration with the frame in the un-collapsed state; or at least one of the first support element or the second support element is connectable to respectively the first plate and the second plate for the un-collapsed state, and disconnectable from respectively the first plate and the second plate for the collapsed state.

15. The frame of claim 1, wherein the frame comprises at least one of:

in the un-collapsed state, a first end and a second end spaced from the first end along a longitudinal axis of the frame, wherein the void is open at at least one of the first end or the second end; or at least one extendable support element and wherein, with the frame in the un-collapsed state, a stand-off distance is adjustable with the extendable support element.

16. The frame of claim 1, in the un-collapsed state, and the void at least partly comprising the explosive material, the frame at least part of the linear shaped charge.

17. The frame of claim 1, in the un-collapsed state, the void comprising at least one shaped element on part of the first surface and on part of the second surface, to reduce the volume of the void packable with the explosive material and to reduce the surface area of the first surface and the surface area of the second surface contactable with the explosive material in the void.

18. The frame of claim 17, wherein the at least one shaped element is dimensioned such that the part of the first surface and the part of the second surface determine a stand-off distance for the linear shaped charge with a reduced volume of the void packable with the explosive material.

19. A frame for forming a linear shaped charge comprising a liner and explosive material, the frame comprising:

a first plate comprising:

a first layer of plastic material;

a first metallic layer on the first layer of plastic material, the first metallic layer having a first surface;

a second plate comprising:

a second layer of plastic material; and a second metallic layer on the second layer of plastic material, the second metallic layer having a second surface, the second plate hingeably connected to the first plate by the plastic material of the first plate and the second plate; and a base assembly connected to the first plate and the second plate, the frame configurable between:

an un-collapsed state with:

a stand-off space between:

a first portion of the first plate;

a second portion of the second plate; and the base assembly; and the liner of the linear shaped charge, the liner comprising the first metallic layer positioned relative to the second metallic layer such that the first surface is angled relative to the second surface by an angle within the stand-off space of less than 180°, and a collapsed state with the stand-off space at least partly collapsed.

20. The frame of claim 19, wherein at least one of:

i) the base assembly is hingeable between a folded configuration, with the frame in the collapsed state, and an unfolded configuration with the frame in the un-collapsed state;

ii) the base assembly comprises a third plate, hingeably connected to the first plate, and a fourth plate hingeably connected to the second plate and hingeably connected to the third plate;

iii) in the un-collapsed state, the base assembly, the first plate and the second plate together correspond with a stand-off space;

iv) in the un-collapsed state, the base assembly, the first plate and the second plate together correspond with a stand-off space, and the stand-off space is substantially triangular in cross-section taken in a plane perpendicular a longitudinal axis of the frame;

v) the base assembly comprises a third plate, hingeably connected to the first plate, and a fourth plate, hingeably connected to the second plate and hingeably connected to the third plate, wherein with the frame in the un-collapsed state the third plate and the fourth plate together correspond with a base side of the stand-off space; or vi) with the frame in the un-collapsed state, the base assembly at least partly holds the frame in the un-collapsed state.

21. A kit for forming a linear shaped charge comprising a liner and explosive material, comprising:

a frame comprising:

a first plate comprising:

a first layer of plastic material; and a first metallic layer on the first layer of plastic material, the first metallic layer having a first surface; and a second plate comprising:

a second layer of plastic material; and a second metallic layer on the second layer of plastic material, the second metallic layer having a second surface, the second plate hingeably connected to the first plate by the plastic material of the first plate and the second plate, the frame configurable between:

an un-collapsed state with:

a void for receipt of the explosive material, with the first surface as a first side of the void and the second surface as a second side of the void, and the liner of the linear shaped charge, the liner comprising the first metallic layer positioned relative to the second metallic layer such that the first surface is angled relative to the second surface by an angle within the void of greater than 180°; and a collapsed state with the void at least partly collapsed; and at least one shaped element receivable by the void to reduce the volume of the void packable with the explosive material and to reduce the surface area of the first surface and the surface area of the second surface contactable with the explosive material in the void.

22. The kit of claim 21, wherein the at least one shaped element comprises: i) a first shaped element for contact with part of the first surface, to reduce the surface area of the first surface contactable with the explosive material in the void, and ii) a second shaped element for contact with part of the second surface, to reduce the surface area of the second surface contactable with the explosive material in the void.

23. The kit of claim 21, wherein the at least one shaped element is dimensioned such that, with the at least one shaped element received by the void and on part of the first surface and on part of the second surface, the part of the first surface and the part of the second surface determine a stand-off distance for the linear shaped charge with a reduced volume of the void packable with the explosive material.

24. A method of assembling a linear shaped charge comprising a liner and explosive material, the method comprising:

un-collapsing a frame from a collapsed state to an un-collapsed state, the frame comprising: a first plate comprising: a first layer of plastic material; a first metallic layer on the first layer of plastic material, the first metallic layer having a first surface; and a second plate comprising a second layer of plastic material; and a second metallic layer on the second layer of plastic material, the second metallic layer having a second surface, the second plate hingeably connected to the first plate by the plastic material of the first plate and the second plate, the frame configurable between: the un-collapsed state with: a void for receipt of explosive material, with the first surface as a first side of the void and the second surface as a second side of the void, and the liner of the linear shaped charge, the liner comprising the first metallic layer positioned relative to the second metallic layer such that the first surface is angled relative to the second surface by an angle within the void of greater than 180°; and the collapsed state with the void at least partly collapsed; and packing the void at least partly with the explosive material explosive material.

* * * * *